United States Patent [19]

Peavey

[11] 4,305,320

[45] Dec. 15, 1981

[54] SELECTOR SWITCH

[76] Inventor: Hartley D. Peavey, 711 A St., Meridian, Miss. 39301

[21] Appl. No.: 947,073

[22] Filed: Sep. 29, 1978

[51] Int. Cl.[3] ..... G10H 3/18

[52] U.S. Cl. ..... 84/1.16

[58] Field of Search ..... 84/1.16, 1.15, 267, 84/299, 313; 200/329, 330, 332, 339

[56] References Cited

U.S. PATENT DOCUMENTS

| | | | |
|---|---|---|---|
| 2,714,326 | 8/1955 | McCarty | 84/299 |
| 2,964,985 | 12/1960 | Webster | 84/1.15 |
| 3,085,460 | 4/1963 | Edwards | 84/1.16 X |
| 3,398,623 | 8/1968 | Smith | 84/267 |
| 3,620,117 | 11/1971 | Rusch | 84/313 |
| 4,127,754 | 11/1978 | Josemans et al. | 200/339 X |

*Primary Examiner*—Stanley J. Witkowski
*Attorney, Agent, or Firm*—Victor J. Evans & Co.

[57] ABSTRACT

A selector switch for musical instruments such as electric guitars is provided with a palm switch that can be manually actuated so that any of the various pick-ups of the guitar can be actuated, so that there is a convenient method of switching to either one or both of the electric pick-ups for treble sounds, bassy sounds and the like. The selector switch includes a construction that does not require use of the fingers or excess movement of the playing hand in order to actuate the pick-up selector switch. A rocker switch is provided with three positions that can be actuated with the heel of the players hand.

3 Claims, 6 Drawing Figures

FIG. 1.
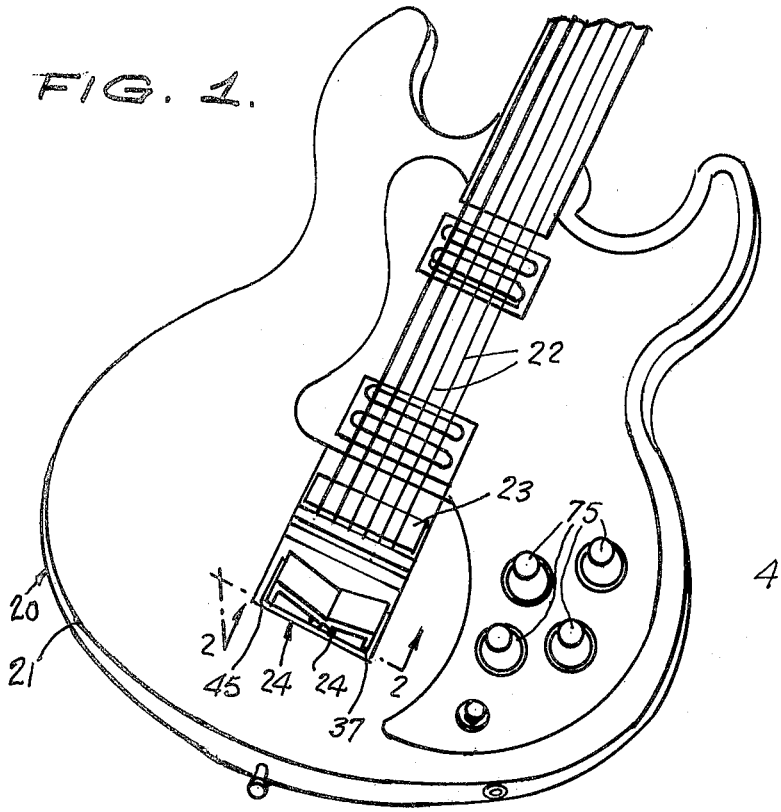
FIG. 3.
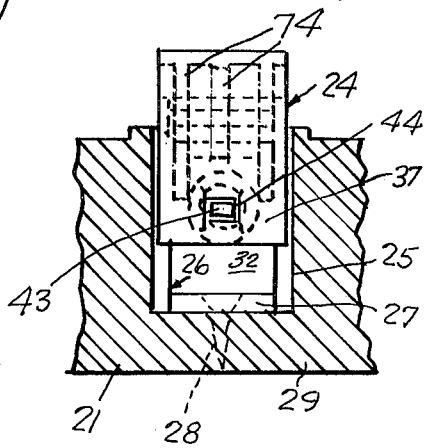
FIG. 2.
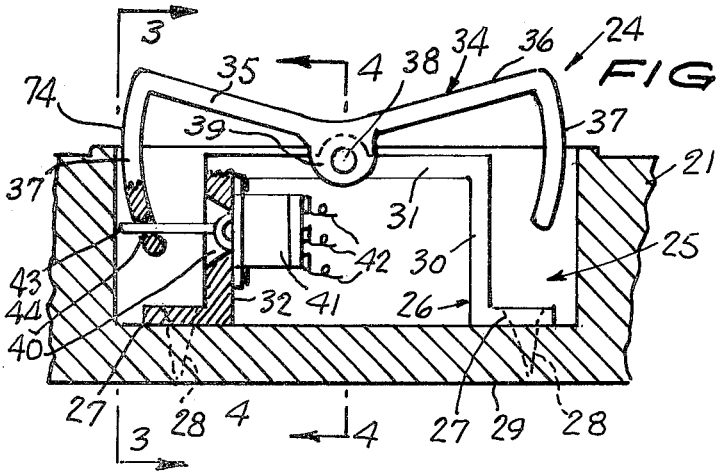
FIG. 4.
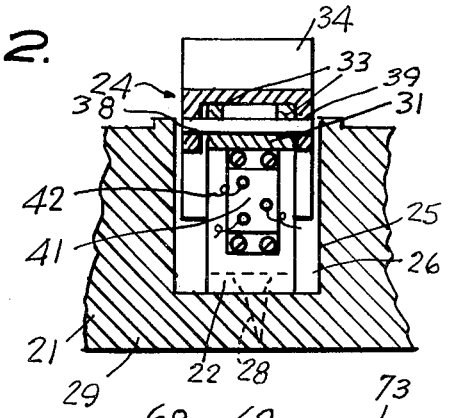
FIG. 5.
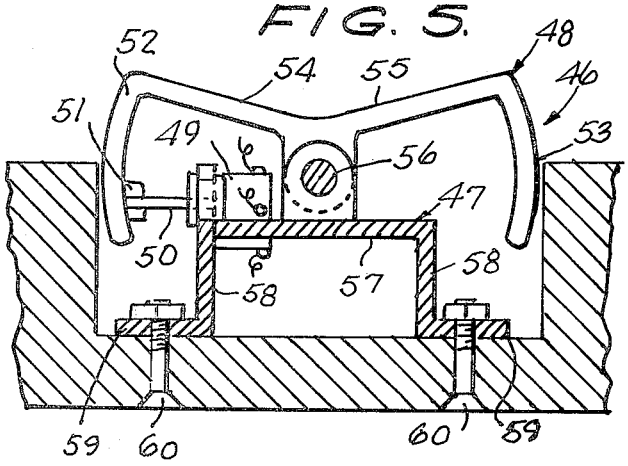
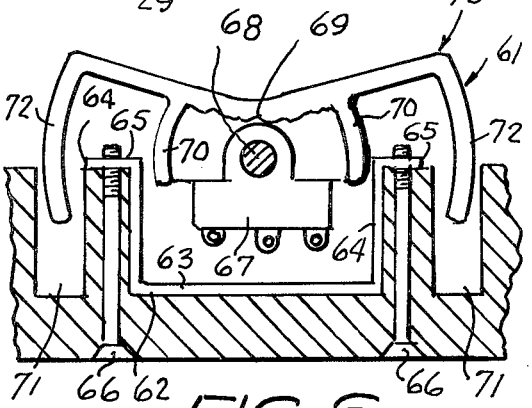
FIG. 6.

SELECTOR SWITCH

BACKGROUND OF THE INVENTION

The following patents are all that are known to applicant and applicant's agent which would have any bearing on the patentability of the claims.

| | |
|---|---|
| 2,714,326 McCarty | 3,398,623 Smith |
| 2,964,985 Webster | 3,620,117 Rusch |
| 3,085,460 Edwards | |

The patent to McCarty (U.S. Pat. No. 2,714,326) relates to a stringed musical instrument having pick-ups 8, 8 controlled by a switch 9 with tone and volume control elements 10 in body having finger pieces 13.

The patent to Webster (U.S. Pat. No. 2,964,985) relates to a string instrument having bass and treble pick-ups slidable within a body recess with volume and tone controls.

The patent to Edwards (U.S. Pat. No. 3,085,460) relates to an electric guitar having pick-ups 21,22 selected by means of a switch 31 actuated by a button 31*a* on the upper surface of the body remote from the strings.

The patent to Smith (U.S. Pat. No. 3,398,623) relates to a musical instrument having pick-ups 29,30 with associated bank of switches 31 and volume and tone control knobs 32,33.

The patent to Rusch (U.S. Pat. No. 3,620,117) relates to a manual vibrato for a stringed instrument in the form of a steel bar 38, spring loaded, with an actuating lever 50 for moving the bar relative to the strings.

None of these patents disclose applicant's simple structure as set forth in the claims and hence the claims are believed to be patentable. Copies of the references are enclosed.

FIELD OF THE INVENTION

The present invention relates to electric guitars, and more particularly to a selector switch that provides a convenient method of switching to either or both of the pick-ups such as the pick-up for treble sounds and the pick-up for bassy sounds.

SUMMARY OF THE INVENTION

The present invention relates to a selector switch for musical instruments such as electric guitars and wherein there is provided a manually operable rocker switch and a suitable indicator can be used to indicate the switch position to the user. It is common practice to provide a method of switching to either the pick-up for treble sounds or the pick-ups for the more bassy sounds and heretofor this switching has been accomplished by either a three position toggle switch or slide switches and occasionally a rotary switch has been used. The present invention provides a rocker type switch for pick-up selection. There is provided a rocker type switch which is placed in close proximity to the bridge of the guitar so as to provide three operating, switching positions. Thus, for example, when the rocker is depressed on the top side in one form of the invention, it can actuate the front or bass pick-up; in the middle position both bass and treble pick-ups are utilized, and when the rocker is depressed on the bottom side, it can actuate the treble or bridge pick-up. To permit the guitarist to tell at a glance where he or she is on the switch, a suitable indicating means can be provided to provide a visual indication of the status of the switch.

The primary object of the present invention is to provide a selector switch for electric guitars that provides a more convenient and efficient method of switching to various other pick-ups for the guitar.

Still another object of the present invention is to provide an electric guitar selector switch mechanism that is simple and inexpensive to manufacture and install and which is efficient to use.

Other objects and advantages will become apparent in the following specification when considered in light of the attached drawings.

BRIEF DESCRIPTION OF THE DRAWINGS

FIG. 1 is a fragmentary perspective view of an electric guitar showing the selector switch mounted therein;

FIG. 2 is an enlarged sectional view taken on the lines 2—2 of FIG. 1;

FIG. 3 is a sectional view taken on the line 3—3 of FIG. 2;

FIG. 4 is a sectional view taken on the line 4—4 of FIG. 2;

FIG. 5 is a sectional view generally similar to FIG. 2 but illustrating a modification; and FIG. 6 is a sectional view illustrating a further modification.

DESCRIPTION OF THE PREFERRED EMBODIMENTS

Referring in detail to the drawings, wherein like reference characters indicate like parts throughout the several figures, and more particularly to FIGS. 1 through 4 of the drawings, the numeral 20 indicates an electric guitar, FIG. 1, that includes a body, and the guitar 20 is adapted to include the usual pick-ups for treble sounds, bassy sounds and the like. The guitar further includes strings 22 and a bridge 23, and in accordance with the present invention there is provided a selector switch that is indicated by the numeral 24.

A recess 25 is provided in the guitar body 21, and bracket or support member 26 is mounted in the recess 25, FIG. 2. The bracket 26 includes flanges 27 that have securing elements such as screws 28 extended therethrough for fastening the bracket 26 to the bottom 29 of the guitar body 21. The bracket 26 further includes spaced apart side portions 32 and 30 that are interconnected by a cross piece 31.

A rocker 34 is provided that includes portions 35 and 36 that are arranged angularly with respect to each other, and guide members or portions 37 extend from the ends of the portions 35 and 36. Upstanding ribs 33 may be provided on the portion 31, and pivot pin 38 extends through registering apertures or openings in the portion 39 of the rocker 34 and through corresponding registering apertures in the top portion 31 of the bracket 26.

The side member 32 of the bracket 26 is provided with a slot 40, FIG. 2, and a switch 41 is secured to the inner surface of the side portion 32, there being an actuating finger 43 operatively connected to the switch 41, and the finger 43 extends through an opening 44 in one of the guide portions 37.

Attention is directed to FIG. 5 of the drawings wherein there is illustrated a modified selector switch that is indicated generally by the numeral 46, and the selector switch mechanism 46 includes a mounting bracket 47 as well as a rocker 48. A switch element 49 is mounted on the bracket 47, and an actuating arm or finger 50 extends from the switch 49 to a bushing 51 in a guide portion 52 of the rocker 48. The rocker 48 includes a opposite guide portion 53, and the rocker 48 further includes angularly disposed top portions 54 and 55. Suitable securing elements such as bolt and nut assemblies 60 serve to secure the flange portions 59 of the bracket 47 to the bottom of the guitar body.

Attention is directed to FIG. 6 of the drawings wherein the numeral 61 indicates a further modified or alternative form of the selector switch of the present invention that includes a bracket 62 that has a bottom portion 63 as well as upstanding portion 64 that terminate in flanges 65, and securing elements such as the bolt and nut assembly 66 serve to secure the flange portions 65 to the guitar body. A switch 67 is adapted to be electrically connected to a guitar pick-up, and shaft 68 is operatively connected to the switch 67 for controlling the switch. The shaft 68 may be rotated by teeth 69 on the rocker 73, and guides 70 extend from the rocker 73. Guide portions 72 are provided on the rocker 73 as shown, and the recesses 71 in the guitar body are adapted to receive the guide portions 72 of the rocker 73 for the switch 61.

The outer surface of a guide portion such as the guide portion 37 may have markings such as the markings 74 thereon that can be used for providing a visual indication of the position of the switch or rocker.

In FIG. 1 the numeral 75 indicates certain conventional control elements for the guitar.

From the foregoing, it will be seen that there has been provided a selector switch for an electric guitar and the like, and in use with the parts arranged as shown in the drawings, the switch 24 is adapted to be arranged adjacent the guitar bridge 23 as shown in FIG. 1. Then, with the parts arranged as shown, the switch element 41 is adapted to be electrically connected to the pick-ups of the guitar so that by manually moving the rocker 34, the various pick-ups can be selectively actuated. Suitable indicating means can be provided on the switch 24 so that the user can tell at a glance what position the switch is in. For example suitable markings, indicia or the like 74 in the form of painted areas can be arranged on the outer surface of the guide portion 37 so that the user at a glance can tell what position the switch is in. It will be seen that by using the heel of hand the rocker 34 can be pivoted to any of several different positions and the rocker 34 can be pivoted about a axis extending through the pivot pin 38. As the rocker 34 is manually moved, it will move the projecting member 43 so as to selectively actuate the switch 41, and because the switch 41 is electrically connected to the pick-ups, it will be seen that this movement will result in selective actuation of the desired pick-ups.

In the construction shown in FIG. 5 the rocker 48 can similarly be manually pivoted about the pivot pin 56 and because the rod or finger 50 of the switch 49 is engaged in the bushing 51 on the member 52 it will be seen that this rocking movement of the rocker 48 will selectively actuate the switch 49 so that the desired pick-up can be turned on or off.

With reference to the construction shown in FIG. 6, the switch 61 includes a rocker 73 that will selectively actuate switch element 67 as for example by means of teeth 69 on the rocker 73 which can actuate the shaft 68, and this will selectively actuate the desired pick-ups in the proper manner.

The parts can be made of any suitable material and in different shapes and sizes as desired or required.

Further, although the switch 49 and rod 50 have been shown to be connected to the side wall member 52, so that the switch and rod lies in the horizontal plane, they can be vertically oriented so that rotation of the pivot pins 38, 56 etc. actuates the switch.

Having thus described the preferred embodiments of the invention it should be understood that numerous structural modifications and adaptations may be resorted to without departing from the spirit of the invention.

What is claimed is:

1. In a musical instrument, an electric guitar including a body having a bridge, strings and pick-ups, manually operable switch means arranged in close proximity to said bridge, a recess in said guitar body, said selector switch means including a bracket mounted in said recess, a switch element on said bracket, a rocker pivotally connected to said bracket, an actuating member operatively connected to said switch element, and guide members depending from said rocker, one of said guide members having a bushing thereon for receiving the actuating member.

2. In a musical instrument, an electric guitar including a body having a bridge, strings and pick-ups, manually operable selector, switch means arranged in close proximity to said bridge, a recess in said body, said selector switch means including a mounting bracket mounted in said recess including flange portions, securing elements extending through said flange portions for securing said bracket to said guitar body, said bracket including first and second side portions interconnected by a cross piece, a, rocker including a top portion and depending guide portions on the ends thereof, a pivot element pivotally connecting said rocker to said bracket, one of said side portions having a slot therein, a switch element for pick-up selection mounted adjacent the inner surface of said one side portion, an actuating finger extending through said slot and operatively connected to said switch element, there being an opening in one of said guide portions for receiving said finger.

3. The structure as defined in claim 2 and further including visual indicator means on said switch means for indicating the position of said switch means.

* * * * *